United States Patent [19]

Caras et al.

[11] 4,346,951

[45] Aug. 31, 1982

[54] METHOD FOR PROVIDING A GAS RESERVOIR FOR A GAS DISPLAY PANEL

[75] Inventors: Bernard Caras, Princeton; Robert E. Kollmyer, Bridgewater, both of N.J.

[73] Assignee: Burroughs Corporation, Detroit, Mich.

[21] Appl. No.: 161,155

[22] Filed: Jun. 19, 1980

[51] Int. Cl.[3] ..... H01J 9/18

[52] U.S. Cl. ..... 316/19; 316/20

[58] Field of Search ..... 316/17, 18, 19, 20; 313/188, 220

[56] References Cited

U.S. PATENT DOCUMENTS

| | | | |
|---|---|---|---|
| 3,600,626 | 8/1971 | Kupsky | 313/220 |
| 3,634,720 | 1/1972 | Kupsky | 313/220 |
| 3,654,507 | 4/1972 | Caras et al. | 313/220 X |
| 3,778,127 | 12/1973 | Langston, Jr. et al. | 313/220 X |
| 3,934,172 | 1/1976 | Okamoto | 313/220 X |
| 4,139,250 | 2/1979 | Jacobs et al. | 316/19 |

*Primary Examiner*—Gil Weidenfeld
*Assistant Examiner*—Fred A. Silverberg
*Attorney, Agent, or Firm*—Kevin R. Peterson; Robert A. Green; David G. Rasmussen

[57] ABSTRACT

Disclosed is a display panel and method of making the panel. The panel is made up of a thin, flat envelope comprising a base plate and a face plate and including a relatively large-volume gas reservoir formed by an auxiliary plate spaced from and hermetically secured to the outer surface of the base plate. The reservoir communicates with the interior of the panel through one or more holes in the base plate. The reservoir is attached to the panel, and the panel is processed by a method which includes maintaining proper temperature distribution through the various parts of the panel.

3 Claims, 6 Drawing Figures

METHOD FOR PROVIDING A GAS RESERVOIR FOR A GAS DISPLAY PANEL

SUMMARY OF THE INVENTION

Thin, flat gas-filled display panels have come into use in recent years, and such panels generally comprise a gas-filled envelope made up of a base plate and face plate hermetically sealed together and including operating electrodes formed on the base plate and face plate inside the envelope. In such panels, the base plate and face plate are closely spaced, with other parts and electrodes between them, and the resultant gas volume is relatively small. Under some circumstances, as the panel is operated, the gas content changes, for example, xenon is absorbed by various panel parts, and the panel characteristics are altered.

In order to avoid the problem described above, a relatively large gas volume is maintained available for the interior of the panel by means of an auxiliary gas reservoir provided coupled to the outside of the panel base plate and communicating with the interior of the panel.

The provision of the gas reservoir complicates assembly of the panel, and the method of the invention insures the maintenance of proper temperature gradients through the various parts of the panel.

DESCRIPTION OF THE INVENTION

Figure 1:
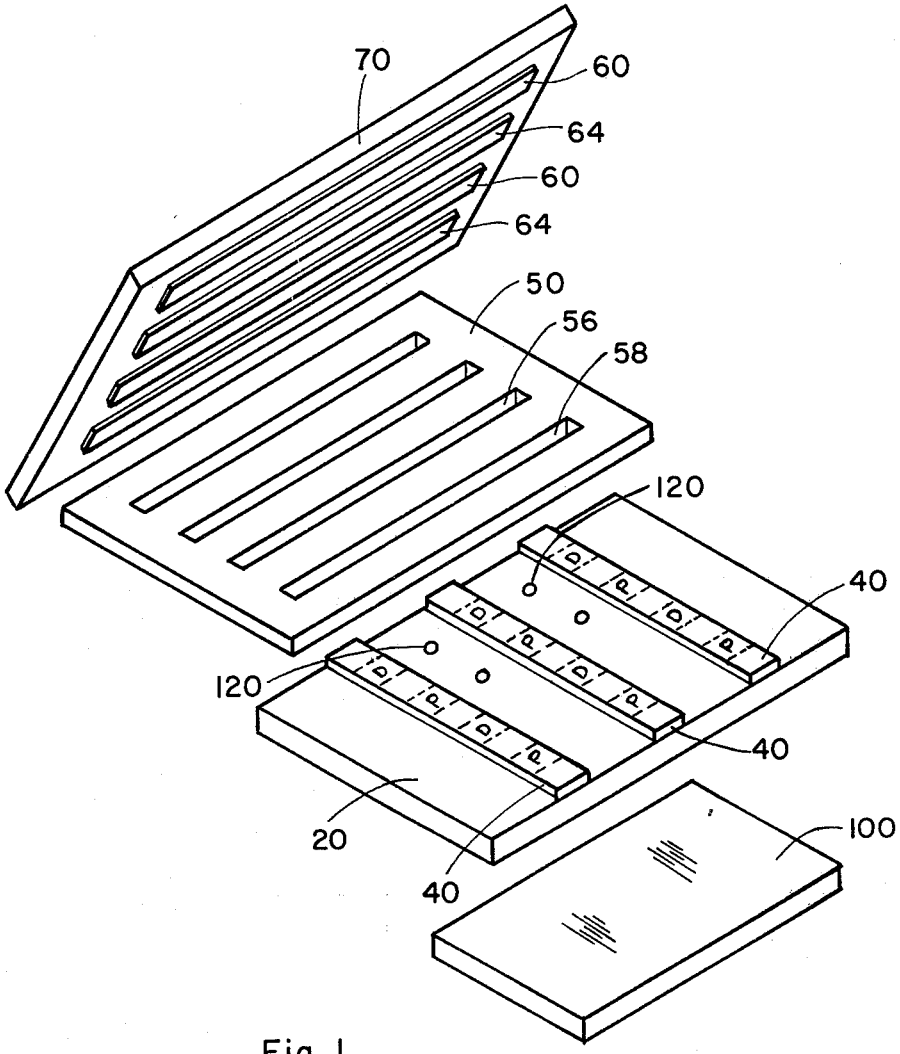
FIG. 1 is a perspective, exploded view of a display panel prepared according the invention.
Figure 2:
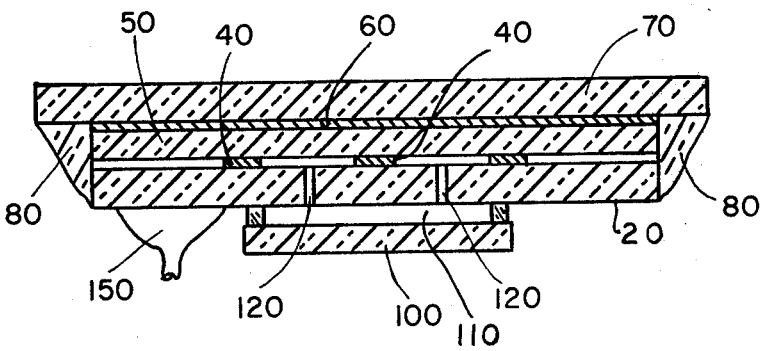
FIG. 2 is a sectional view of the panel of FIG. 1 shown assembled.

The principles of the invention are described with respect to SELF-SCAN panels of the type shown in U.S. Pat. No. Re 29,858 of D. E. Miller, issued Dec. 5, 1978, although they may be employed with other types of gas discharge panels. This patent shows a single layer SELF-SCAN panel and describes its operation and is incorporated herein by reference. Briefly, such a SELF-SCAN panel 10, referring to FIGS. 1 and 2, includes a base plate or substrate 20, on the top surface of which cathode electrode strips 40 are formed, by a silk-screening operation, in a parallel vertical array. An insulating cell sheet 50 is seated on the cathodes. The cell sheet includes parallel slots 56 and 58 which are disposed horizontally transverse to the cathode strips, and these slots subdivide the surfaces of the cathodes, as illustrated by the dash lines in FIG. 1, into discrete areas which are operated as priming cathodes P and display cathodes D. Transparent anode strips 60 and 64 are formed on the glass face plate 70, with each anode strip overlying one of the rows of cathode areas D or P so that there are alternate priming anodes and display anodes which overlie and operate with alternate rows of priming cathodes P and display cathodes D. With the arrangement shown, there are rows and columns of priming cathodes or priming cells and display cathodes or display cells, and, in each column, the priming cells and display cells alternate with each other.

As in all SELF-SCAN panels, panel 10 is also provided with a column of reset cells (not shown) ahead of the first cathode 40 and appropriate keep-alive cell(s) (not shown).

In a completed panel, all parts are hermetically sealed together by a glass frit perimeter seal 80 (FIG. 2), and the panel is filled with an ionizable Penning gas or gas mixture, such as neon and xenon, in any suitable fashion, usually through a tubulation 150.

According to the invention, in order to increase the gas supply available to the panel, a gas reserve glass plate 100 is secured to the rear, outside surface of the base plate 20, with a suitable space 110 (FIG. 2) between the two plates 20 and 100 to provide the desired auxiliary gas volume or reservoir for the interior of the panel. This space 110 is filled with the panel gas, and the gas volume thus formed communicates with the interior of the panel through one or more holes 120 formed in the base plate and extending through the base plate to the interior of the panel. The auxiliary plate may be smaller in area than the base plate.

The method of the invention derives from the discovery that, in a relatively large display panel having an envelope made up of a glass base plate and a glass face plate which are sealed together, when these glass plates are heated as part of the sealing process to form the envelope, the inner or central portions of the plates tend to heat (and cool) more slowly than the edge portions. Because of this differential in temperature across the panel, one or more of the glass plates being sealed may crack. According to the invention, means are provided for insuring proper distribution of temperature throughout the panel during its manufacture to prevent such cracking. In particular, such means are provided to insure that, when the panel is heated or cooled, the central portions of the panel change temperature substantially uniformly with the edge portions of the panel.

Figure 3:
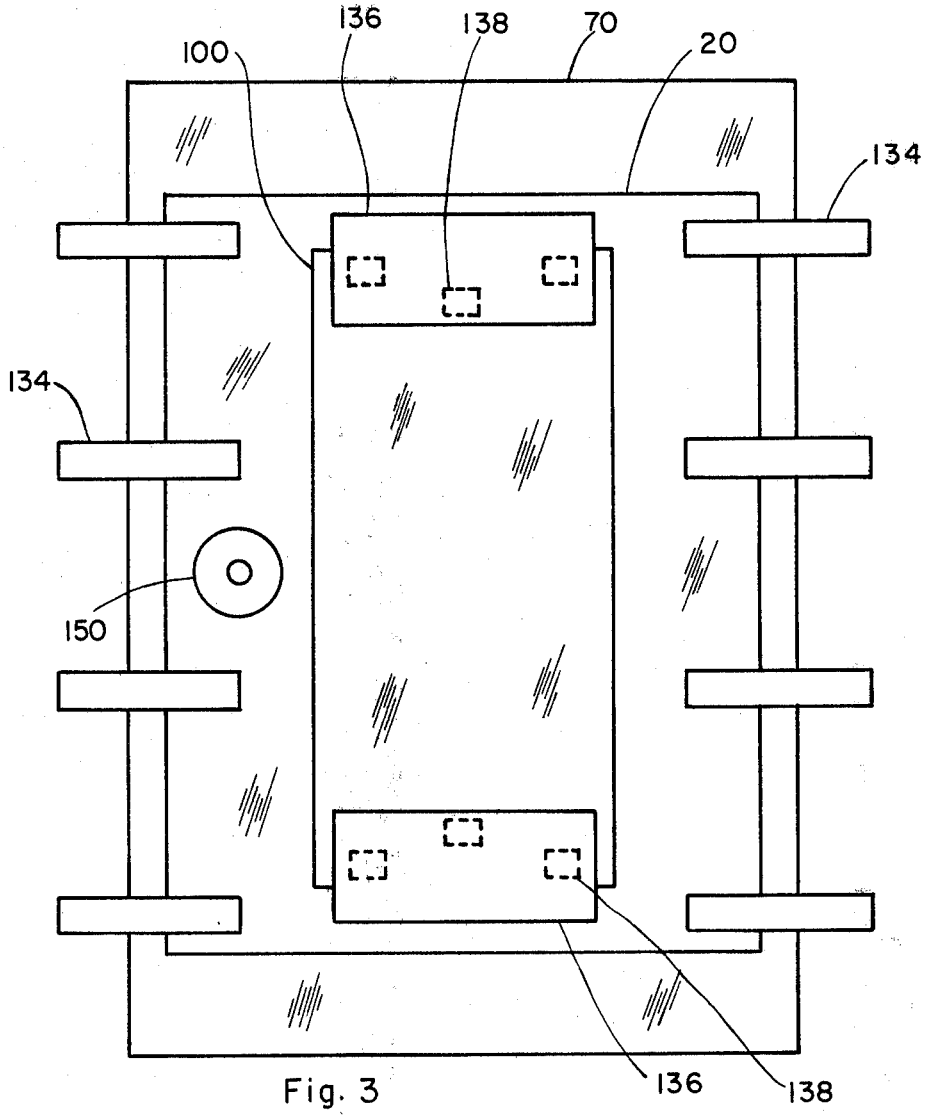
FIG. 3 is a bottom plan view of the panel of the invention at one stage in its manufacture.
Figure 4:
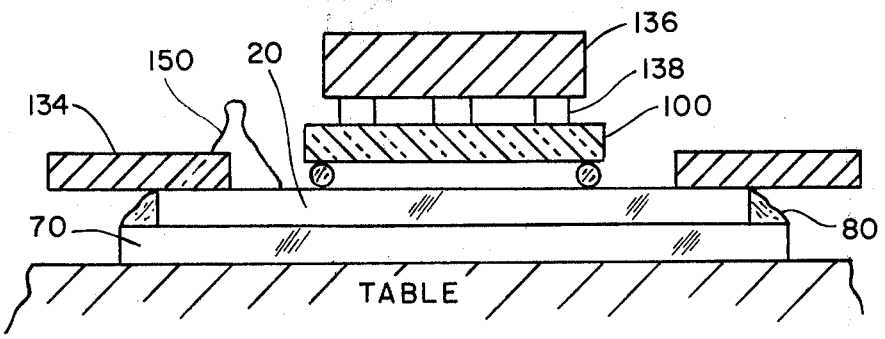
FIG. 4 is a side elevational view of the apparatus shown in FIG. 3.

Thus, in accordance with the invention, referring to FIGS. 3 and 4, all of the panel parts described above are assembled and a sealing material, such as Pyroceram, to form the seal 80, is provided along the contacting perimeters of the base plate and face plate. A similar ring of sealing material is provided between the plate of reserve glass 100 and the base plate to which it is to be sealed.

A plurality of metal clamps 134 are disposed along the aligned perimeter portions of the base plate 20 and face plate 70. The clamps hold the two plates and the other panel portions in precise alignment and clamped tightly together to provide a precise seal 80 when the sealing material is heated, melts and then fuses. The clamps may be of any suitable type, for example, as shown in U.S. Pat. No. 3,920,235 of Hermanns, issued Nov. 18, 1973. The clamps 134 are of suitable mass and are used in suitable number of distribution to provide the required lag in temperature change in the edge of the panel as the center of the panel changes temperature, both on heating and cooling.

In addition, relatively large metal weights 136 are placed on the ends of the reserve glass 100 and resting on a plurality of small thermal insulator spacers 138. Keeping the weights 136 out of contact with the glass by means of spacers 138 avoids problems due to the different thermal expansion characteristics involved while providing the desired thermal lag.

With the parts thus assembled, heat is applied to melt and fuse the sealing frits, with the parts heating properly and cooling properly without cracks developing.

Figure 5:
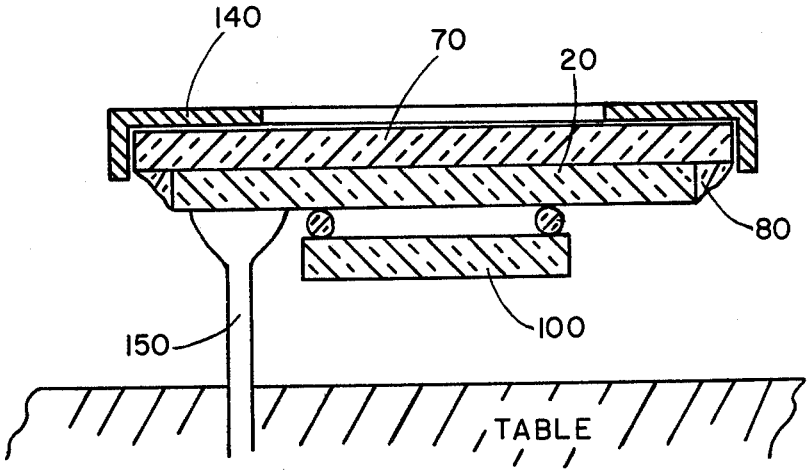
FIG. 5 is a side elevational view of the panel of the invention at another stage in its manufacture.
Figure 6:
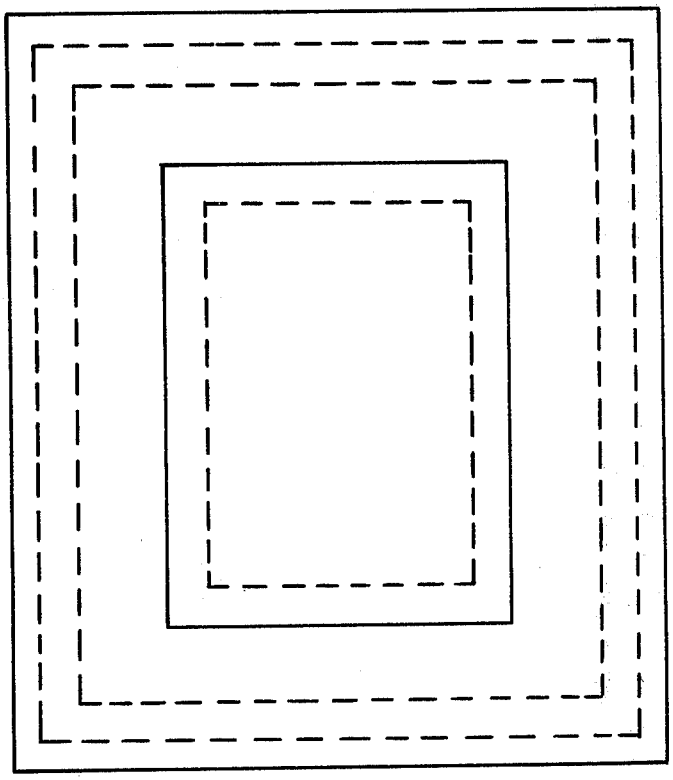
FIG. 6 is a plan view of a portion of the apparatus of FIG. 5.

In the next procedure, referring to FIGS. 5 and 6, wherein the sealed panel is baked out and exhausted and filled with the desired gas, similar precautions are taken to prevent differential heating, and this is achieved by means of a rectangular insulating heat sink 140 in the form of a frame, having an L-shaped cross-section, which is placed on the face plate 70 with one leg of the "L" in contact with the edge of the base plate. The center of the frame is open so that the panel can change temperature as desired. This arrangement also provides the desired uniform heating and cooling of the parts. In this step, as shown in FIG. 5, the panel is oriented with the face plate up and supported by its tubulation 150 connected to a pump.

What is claimed is:

1. The method of making a display panel comprising the steps of loosely assembling a glass base plate and a glass face plate with a sealing frit to form the panel envelope, seating an auxiliary glass plate on the outer surface of said base plate with a sealing frit between them, placing a plurality of metal clamps along the perimeter of the envelope formed by the base plate and face plate while leaving the central portions of the base plate and face plate open to the atmosphere, placing metal weights at the ends of said auxiliary glass plate but leaving the center thereof exposed to the atmosphere, and applying heat to cause the base plate and face plate to become sealed together and to cause the auxiliary plate to become sealed to said base plate, the entire panel undergoing substantially uniform temperature change due to the presence of said metal clamps and said metal weights.

2. The method of claim 1 and including the steps of providing a frame having an L-shaped cross-section on the panel face plate, in contact with the perimeter of the face plate, and baking out and exhausting the panel and filling it and the reservoir with gas.

3. The method of making a display panel comprising the steps of loosely assembling a glass base plate and a glass face plate with a sealing frit to form the panel envelope, seating an auxiliary glass plate on the outer surface of said base plate with a sealing frit betweem them, placing a plurality of metal clamps along the perimeter of the envelope formed by the base plate and face plate while leaving the central portions of the base plate and face plate open to the atmosphere, placing metal weights at the ends of said auxiliary glass plate but leaving the center thereof exposed to the atmosphere, applying heat to cause the base plate and face plate to become sealed together and to cause the auxiliary plate to become sealed to said base plate, the entire panel undergoing substantially uniform temperature change due to the presence of said metal clamps and said metal weights, and applying a frame-like heat sink to the periphery of the face plate while simultaneously baking, evacuating and filling the previously sealed envelope with an ionizable gas.

* * * * *